US007107677B2

(12) United States Patent
Lyons

(10) Patent No.: US 7,107,677 B2
(45) Date of Patent: Sep. 19, 2006

(54) PROCESS, APPARATUS, AND KIT FOR ASSEMBLING AND DISASSEMBLING A CRYOGENIC PUMP

(75) Inventor: Michael W. Lyons, Henderson, NV (US)

(73) Assignee: Nikkiso Cyro, Incorporated, North Las Vegas, NV (US)

( * ) Notice: Subject to any disclaimer, the term of this patent is extended or adjusted under 35 U.S.C. 154(b) by 384 days.

(21) Appl. No.: 10/628,937

(22) Filed: Jul. 28, 2003

(65) Prior Publication Data

US 2004/0050073 A1 Mar. 18, 2004

Related U.S. Application Data

(60) Provisional application No. 60/399,009, filed on Jul. 26, 2002.

(51) Int. Cl.
*B23P 15/00* (2006.01)
*B23Q 3/00* (2006.01)

(52) U.S. Cl. ..... 29/888.02; 29/888.021; 29/464; 29/468; 29/281.4; 29/426.3; 269/289 MR

(58) Field of Classification Search ..... 29/888.02–888.025, 464, 281.1, 281.4, 428, 29/426.1, 426.3; 269/289 MR
See application file for complete search history.

(56) References Cited

U.S. PATENT DOCUMENTS

| | | | | |
|---|---|---|---|---|
| 2,825,477 | A * | 3/1958 | Ross | 29/559 |
| 3,894,403 | A | 7/1975 | Longsworth | |
| 4,295,257 | A * | 10/1981 | Strohs | 29/240 |
| 4,504,047 | A * | 3/1985 | Jantzen | 269/43 |
| 4,567,649 | A * | 2/1986 | Ades et al. | 29/800 |
| 4,726,108 | A | 2/1988 | Poloni | |
| 4,745,761 | A | 5/1988 | Bazaj et al. | |
| 5,582,017 | A | 12/1996 | Noji et al. | |
| 5,787,940 | A | 8/1998 | Bonn et al. | |
| 6,354,088 | B1 | 3/2002 | Emmer et al. | |

OTHER PUBLICATIONS

International Search Report; Internatioinal Application No. PCT/IB 03/03794; International Filing Date Jul. 28, 2003; Date of Mailing; Jan. 21, 2004.

* cited by examiner

*Primary Examiner*—Eric Compton
(74) *Attorney, Agent, or Firm*—Cantor Colburn LLP

(57) ABSTRACT

A process, apparatus, and kit for horizontally assembling a cryogenic pump with an apparatus generally including a workstand, a plurality of support stands longitudinally spaced apart from the workstand and a roller transport structure. The kit includes the apparatus and a beam crane for attachment to the apparatus for assembling and disassembling the cryogenic pump at the point of use.

28 Claims, 11 Drawing Sheets

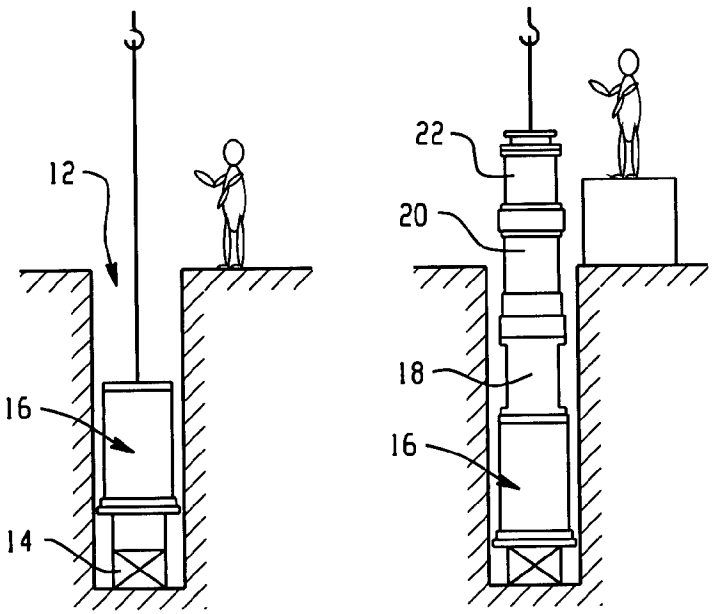
Fig. 1A
PRIOR ART
Fig. 1B
PRIOR ART
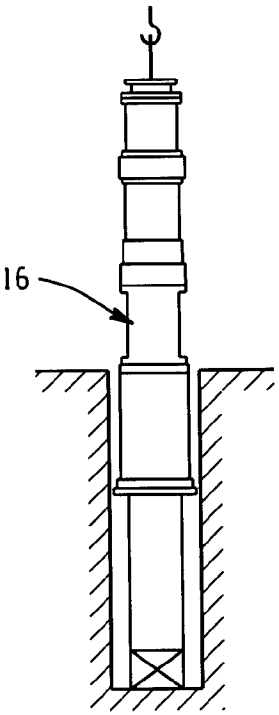
Fig. 1C
PRIOR ART
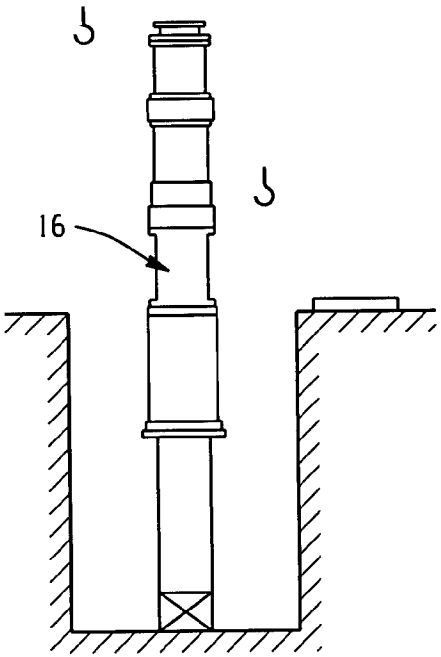
Fig. 1D
PRIOR ART

PROCESS, APPARATUS, AND KIT FOR ASSEMBLING AND DISASSEMBLING A CRYOGENIC PUMP

CROSS REFERENCE TO RELATED APPLICATIONS

This application relates to and claims priority to U.S. Provisional Application No. 60/399,009 filed on Jul. 26, 2002.

BACKGROUND

The present disclosure relates to cryogenic pumps and more particularly, to processes, apparatuses, and kits for assembling cryogenic pumps.

Cryogenic liquids such as hydrogen, oxygen, nitrogen, argon, liquefied hydrocarbons (e.g., methane, natural gas), and the like, are normally stored in well-insulated, temperature-controlled containers, such as underground storage tanks, to reduce fluid evaporation losses. The cryogenic temperatures of these liquids are generally considered to range from about 125° Kelvin (K) to 0° K.

To transfer such cryogenic fluids between containers or from one container to a point of use, reciprocating- or centrifugal-type mechanical pumps are often employed. These types of cryogenic pumps basically consist of a vertically extending column having an intake, and one or more stages of impellers mounted about a shaft at the lower end of the column. The impellers are driven by the shaft, which extends coaxially upward through the column to a drive motor mounted on top of a discharge head, which is mounted on top of the vertical column. During operation, the pump intake is located at the bottom of the pump and is submerged into the cryogenic liquid. Rotation of the impellers causes the liquid to be drawn into the pump intake and to an outlet conduit in fluid communication with another container, a conduit, or its point of use. Depending upon the particular application, these pumps are normally of substantial size with typical column lengths of about 15 to about 20 feet or more, and column diameters ranging up to about 3 feet or more. The cryogenic pump is thus made up of several major components, each of which may weigh several hundred pounds, wherein the total weight of the cryogenic pump can be in excess of about 10,000 to about 20,000 pounds or more.

Assembly or disassembly of cryogenic pumps is relatively complicated. Many of the components are extremely bulky, and require precise coaxial alignment of separable parts. A drive shaft of about 18 to about 20 feet in length or larger which, in operation, will be driven at several hundred to thousands of revolutions per minute (rpm), must be installed with some degree of precision. Current assembly and disassembly processes include vertically assembling or disassembling the various components that form the cryogenic pump.

FIG. 1 (A–L) illustrates one such prior art process for vertically assembling or disassembling a cryogenic pump. The vertical assembly process typically requires building a special pit area 12 to accommodate the diameter of the pump and staging for use by the assemblers. The pit area 12 is necessary to accommodate a portion of the pump height as it is being assembled as well as for safety considerations associated with vertically stacking the various components to assemble the pump. For example, a suitable pit area for fabricating an 18-foot long cryogenic pump weighing about 8500 pounds is about 4 feet in width, 10 feet in length, and about 9 feet deep. As shown in FIG. 1A, the motor and shaft assembly components 16 are first lowered into the pit area 12 and positioned onto a telescoping workstand 14 located at the bottom of the pit area 12. The motor and shaft assembly 16 are oriented "upside down" and are typically disposed in the pit area 12 by means of an overhead crane, fork truck fitted with an overhead boon, a combination of the crane and fork truck, or the like. Additional component modules 18, 20, 22 of the pump are each then vertically fitted to the motor and shaft assembly 16 in a similar manner as shown in FIG. 1B. Fitting the additional component modules require the assemblers to be able to freely move up and down the staging to access the pump for guiding, mating, and attaching the various component modules as the cryogenic pump is assembled. With regard to the one or more stages of impellers, each impeller as it is fitted to the shaft is offset from the previously fitted impeller by about 30 to about 90 degrees. The orientation of each additional impeller is maintained due to the effect of gravity as the impeller blades are being fitted to the shaft.

Referring now to FIGS. 1D through 1H, once all of the major component modules 16, 18, 20, and 22 of the pump are assembled, it is necessary to rotate the entire pump assembly 180 degrees, such that the pump is in its normal operating position, i.e., the motor and shaft assembly 16 is positioned at the top of the pump 10, the impellers at the bottom of the pump. Again, an overhead crane, fork truck, or the like, is required for rotating the assembled pump into the normal operating position within the pit area 12. Final connections and assembly of secondary or minor components are then made by an assembler to complete the cryogenic pump as shown in FIG. 1I. Referring now to FIGS. 1J through 1L, the pump is now readied for testing, which involves transporting the cryogenic pump to a testing facility for connection to a container of cryogenic liquid, wherein it will be installed in the vertically oriented, normal operating position.

Once the pump has been tested, the cryogenic pump is typically brought back to the pit area 12 for disassembly. Disassembly is required to determine wear patterns and to replace any pump components damaged during testing. The pumps are then reassembled and readied for shipment to the customer. Typically, a cryogenic pump will be assembled, tested, disassembled, and reassembled two or three times prior to shipment to a customer site.

The vertical assembly process is time intensive requiring frequent interaction with overhead cranes, fork trucks with overhead boons, and the like, for assembly, disassembly, and for orienting the pump for testing purposes. Moreover, the known cryogenic pump assembly processes require the use of a special pit area 12 and staging for access to the pump as it is assembled in the vertical direction.

BRIEF DESCRIPTION OF THE DRAWINGS

Referring now to the figures wherein like elements are numbered alike.

BRIEF SUMMARY

Figure 1E:
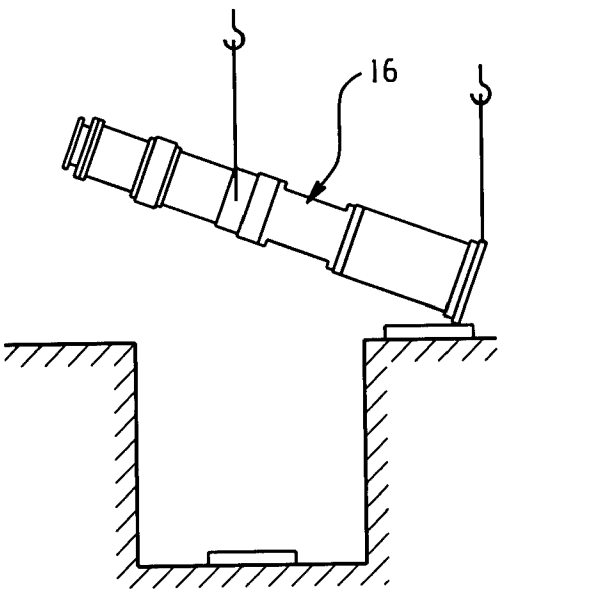
Fig. 1E PRIOR ART
FIG. 1 illustrates a prior art assembly process for vertically assembling a cryogenic pump.
Figure 1F:
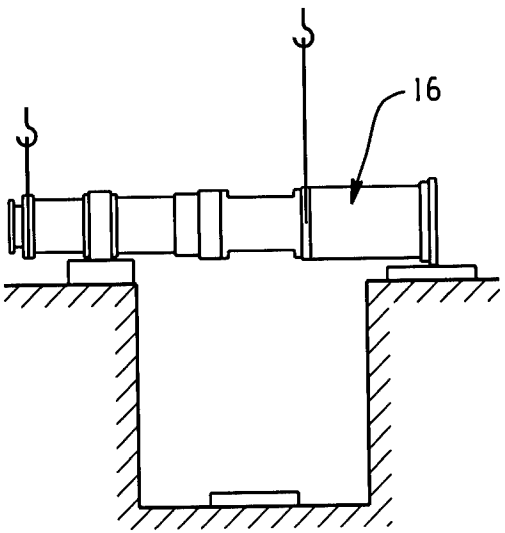
Fig. 1F PRIOR ART
Figure 1G:
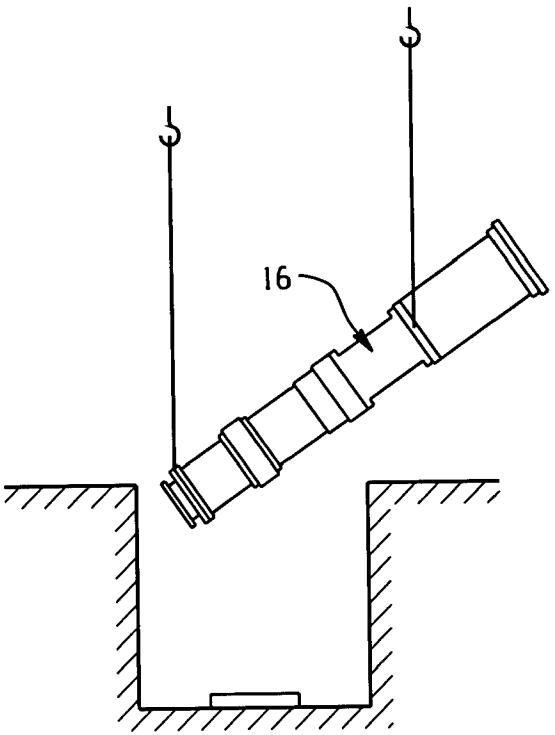
Fig. 1G PRIOR ART
Figure 1J:
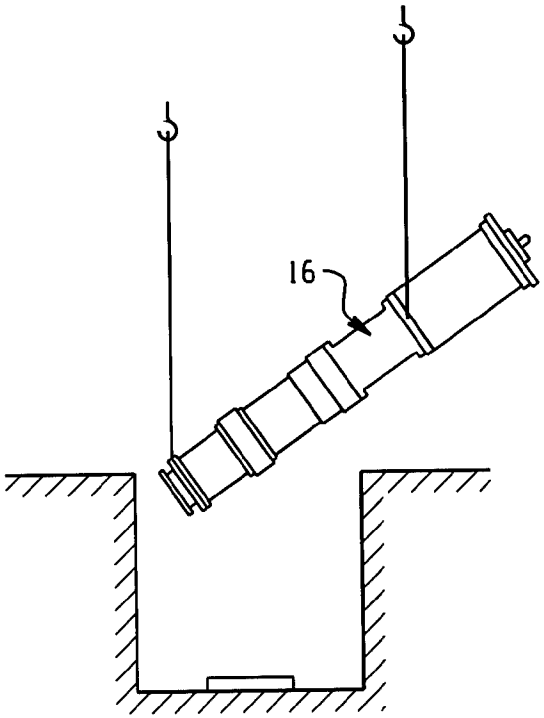
Fig. 1J PRIOR ART
Figure 1I:
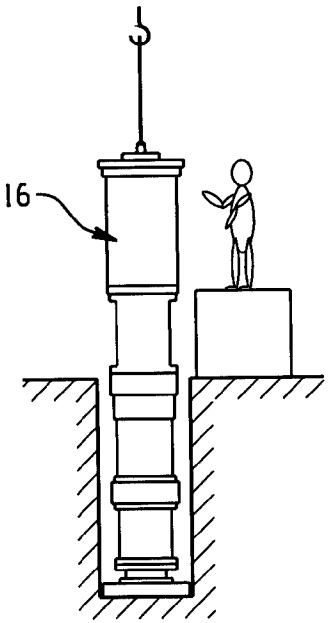
Fig. 1I PRIOR ART
Figure 1H:
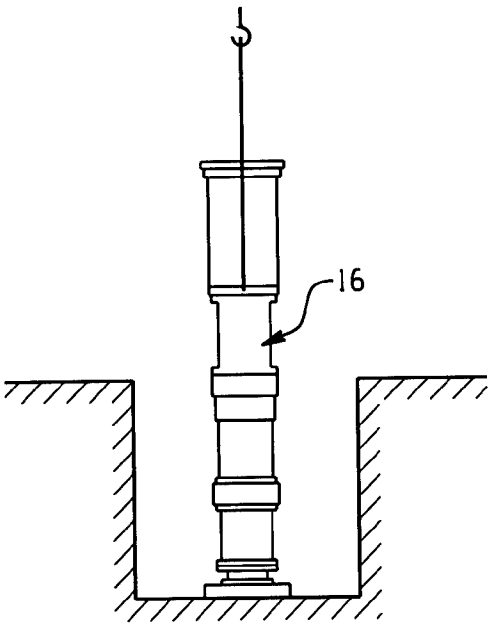
Fig. 1H PRIOR ART
Figure 1L:
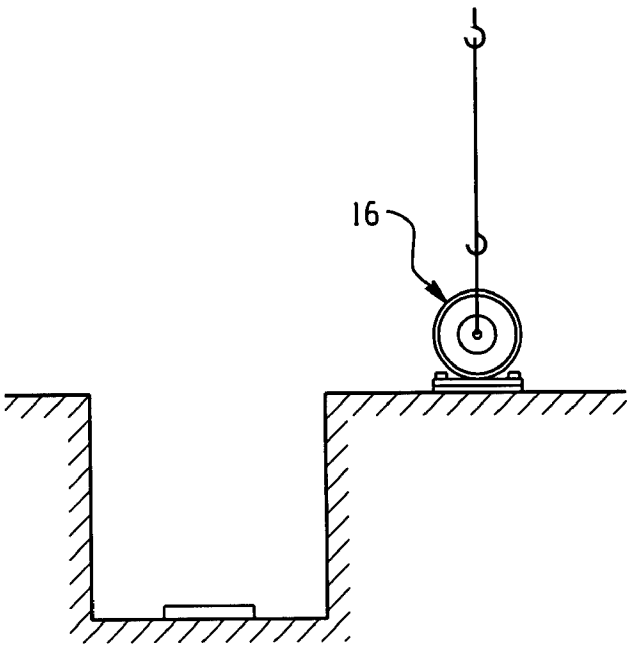
Fig. 1L PRIOR ART
Figure 1K:
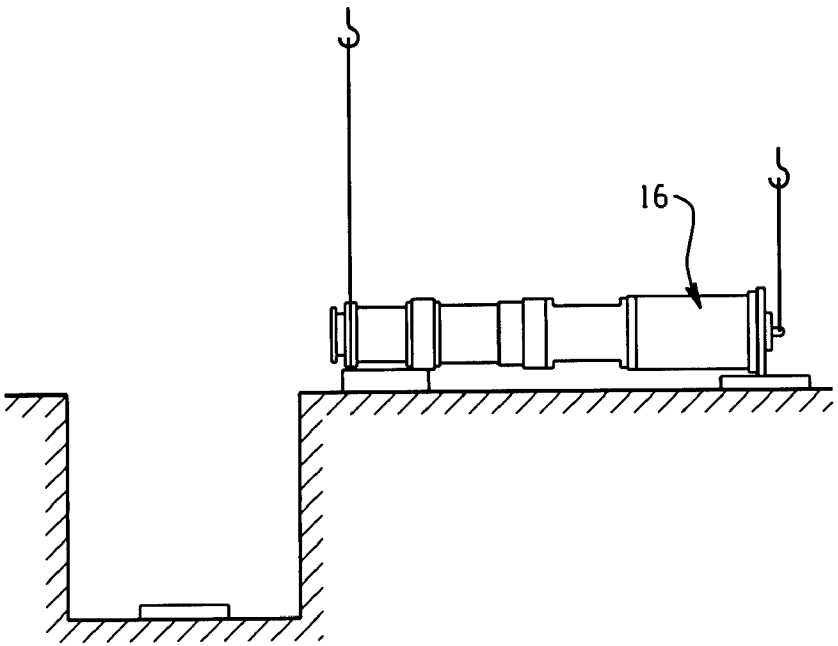
Fig. 1K PRIOR ART

Disclosed herein is an apparatus and process for horizontally assembling and/or disassembling a cryogenic pump. The apparatus comprises a workstand comprising a workstand comprising a base unit including a vertically oriented sidewall and/or frame comprising a recessed portion for accommodating a motor shaft end of the cryogenic pump and means for attaching an end of a cryogenic pump to the workstand a roller support structure comprising a platform and a pivotable arm having one end of the arm pivotably attached to the platform and an unattached other end of the arm comprising a rotatable support; and at least one support stand intermediate the work stand and the rolling support structure.

A process for horizontally assembling a cryogenic pump, comprising horizontally aligning and inserting an end of a motor shaft into a recess of a workstand, wherein the recess is formed in a vertically oriented sidewall and/or frame of the workstand; maintaining alignment of the motor shaft and supporting the motor shaft in a cradle of at least one support stand longitudinally spaced from the base unit; attaching a pump shaft to the motor shaft; supporting and maintaining alignment of the pump shaft with a roller transport structure and/or the at least one support stand, wherein the roller transport structure comprises a platform and a pivotable arm having one end of the arm pivotably attached to the platform and an unattached other end of the arm comprising a rotatable support; and adding additional modules or components to form the cryogenic pump, wherein each additional module or component is oriented horizontally during assembly of the cryogenic pump.

A kit for assembling a cryogenic pump comprising the apparatus described above and a beam crane comprising a first beam vertically extending from the workstand; a second beam vertically extending from ground spaced apart from the first beam; a horizontal beam pivotably attached to the first and second beams, wherein the horizontal beam can be moved into a position parallel and coaxial to a longitudinal axis of the cryogenic pump; a trolley assembly attached to the horizontal beam and adapted to laterally move about a length of the horizontal beam; and a hoist extending from the trolley assembly and adapted for vertical movement.

Further advantages and embodiments of the present disclosure will be understood by those skilled in the art in light of the detailed description and figures.

DETAILED DESCRIPTION

Disclosed herein is a process, apparatus, and kit for assembling or disassembling a cryogenic pump. The process includes horizontally assembling the various components that form the cryogenic pump using an apparatus generally comprising a workstand, a rolling transport structure, and longitudinally spaced apart supports extending from the workstand. The kit includes the apparatus and further includes a beam crane that can be assembled at the point of use, fixedly attached to a base unit of the apparatus and subsequently used for assembling the cryogenic pump with the apparatus. Absent the beam crane, the various components for fabricating the cryogenic pump may be assembled using an overhead crane, a forklift, or by manpower. Advantageously, the apparatus and process do not require fabrication of special pit areas or staging in which to assemble the cryogenic pump. Moreover, the apparatus and process eliminate many of the time intensive steps associated with the vertical assembly/disassembly process. In addition, the apparatus including the beam crane advantageously permits assembly or placement of the cryogenic pump in facilities and environments lacking an overhead crane or having limited space capacity for an overhead crane.

For a better understanding of the process, apparatus, and kit that follows, an exemplary cryogenic pump 30 is shown in FIG. 1. The illustrated cryogenic pump 30 shown is not intended to be limiting and can vary as is known to those skilled in the art, e.g., centrifugal cryogenic pumps, reciprocating type cryogenic pumps, and the like.

As shown, the cryogenic pump 30 generally includes a plurality of interconnected components or modules 32, 34, 36, and 38, disposed within a section pot 40 and a pot cover 41, wherein each component or module is coupled to an adjacent component or module by means of an adapter plate 42. Although the illustrated cryogenic pump 30 includes four modules (32, 34, 36, and 38), the cryogenic pump 30 can have more or less modules depending on the pump design and desired application.

The first module 32 generally comprises a motor assembly. The motor assembly generally includes a motor stator 44, a rotor 46, and a motor shaft 48 contained within a motor housing 50. At one end of the motor housing 50 (i.e., the top end), a discharge manifold 52 is coupled to the motor housing 50 and may be secured by bolts as shown. Motor bearings 54 disposed about the motor shaft 48 may also be included.

The second module 34 generally includes a pump shaft 56, a plurality of impellers 58 mounted onto the pump shaft 56, and a pump extension 60 surrounding a portion of the pump shaft 56 and impellers 58. The pump shaft 56 is coaxially aligned with and coupled to the motor shaft 48. Bearings 62 and a balance drum assembly 64 are disposed about the coupled pump shaft 30 and motor shaft 28. The impellers 58 are preferably staggered about the pump shaft 56. The degree of staggering is dependent on the design of the impellers and related parts that form the impeller 58 (e.g., vane inserts 66, diffuser housings 68, spacers, and the like) and may range from about 10 to about 180 degrees from an adjacent impeller 58. The second module 34 is attached to the first module 32 by means of a first adapter plate 42. The adapter plate 42 is bolted or otherwise secured to the pump extension 60 and the motor housing 50. Similarly, the third module 36 is coupled to the second module 34 by means of a second adapter plate 42, as shown.

The third module 36 includes pump extension 70, and additional impellers 58 disposed about the pump shaft 56 as well as shaft bearings 62, vane inserts 66, diffuser housings 68, and the like, as needed based on the pump design. In the manner previously discussed, a third adapter plate 42 connects the third module 36 to a pump extension 72 in the fourth module 38.

The fourth module 38 further includes a suction manifold 74 attached to the other end of the pump extension 72.

Additional impellers 58 are disposed about the pump shaft 56. Moreover, the pump shaft 56 in this module 38 can include additional shaft bearings 62, a wear ring 76, an inducer 78, and the like.

The cryogenic pump 30 may further include a number of other parts to complete assembly of the pump and to seat the various parts including, but not limited to, collets, seal rings, castle nuts, bearing retainers, split pins, stator pins, baffle plates, vibration sensors, support pipes, and the like.

Figure 2:
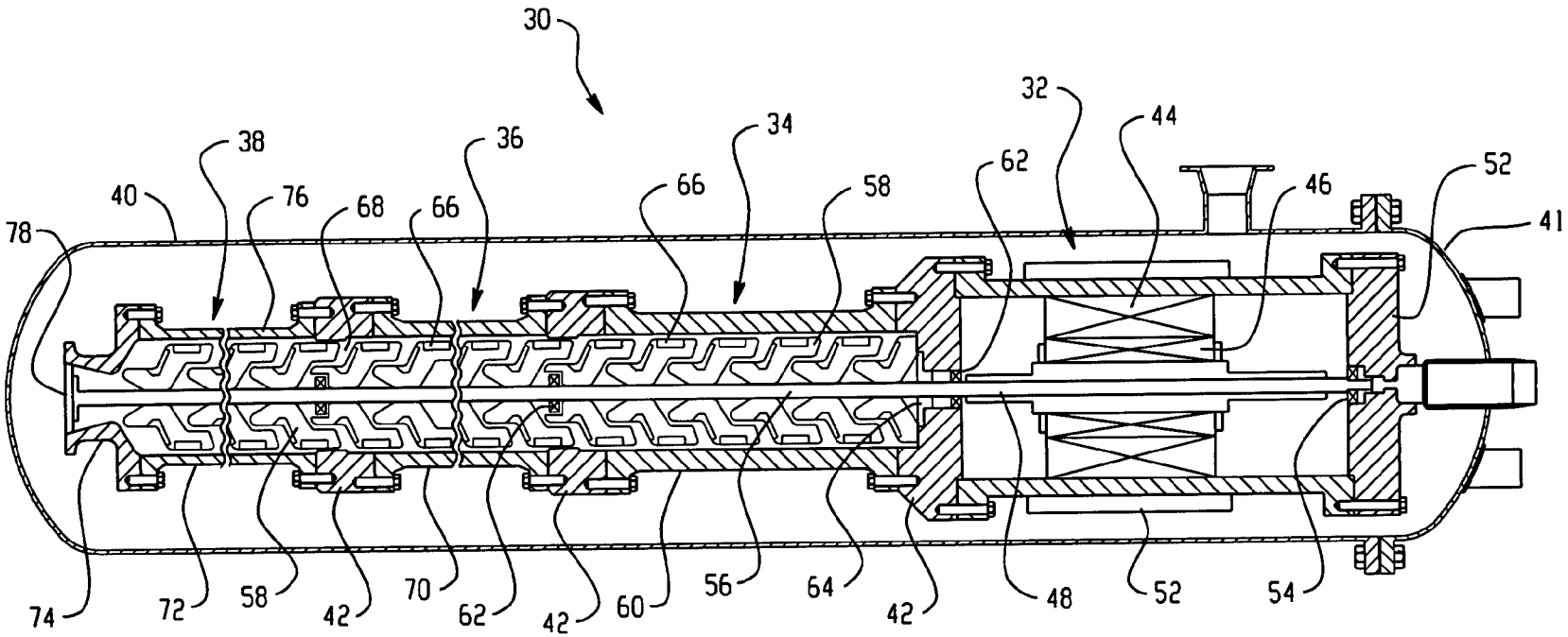
FIG. 2 illustrates an exemplary cryogenic pump.
Figure 3:
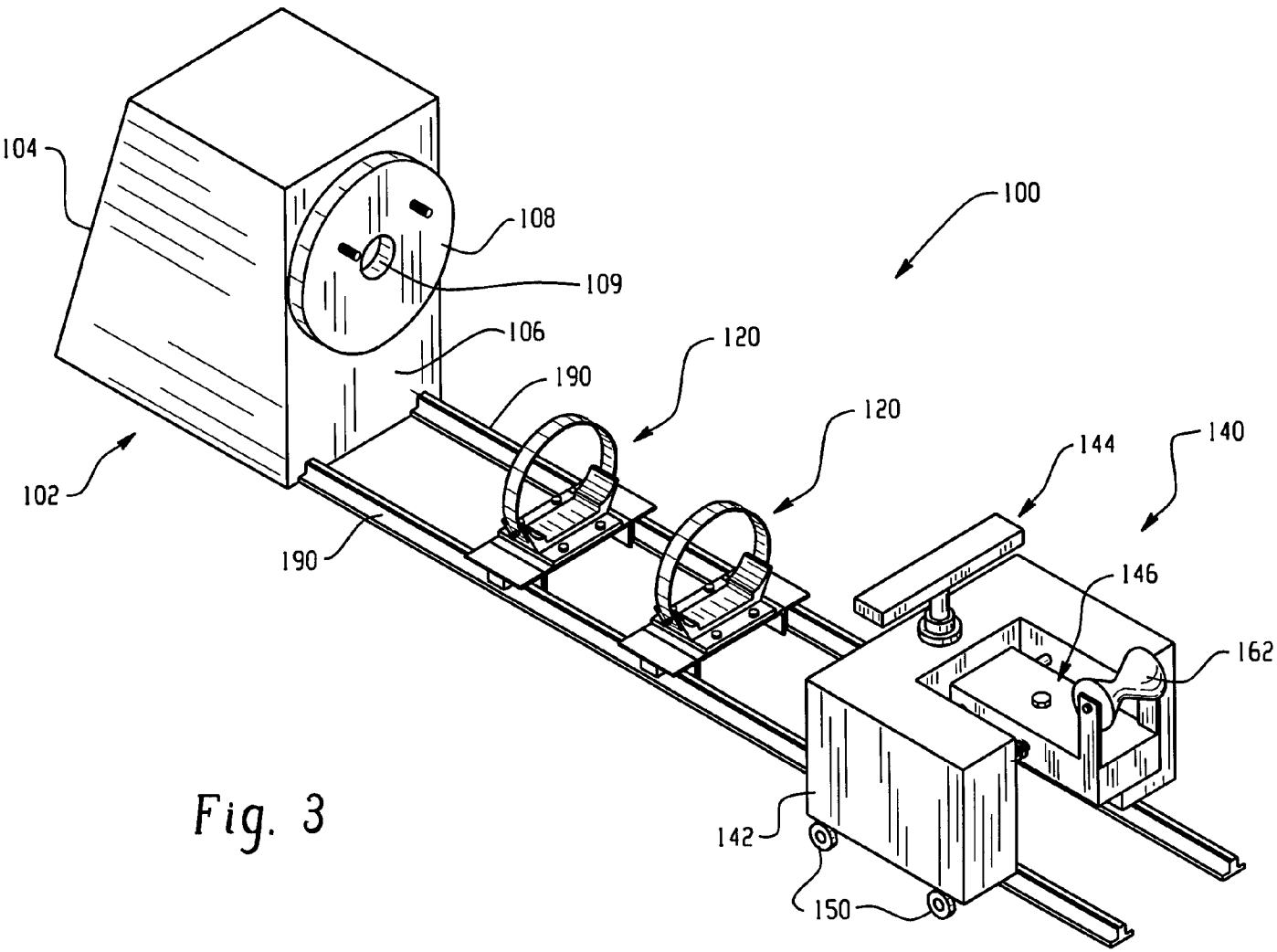
FIG. 3 illustrates a perspective view of an apparatus for horizontally assembling a cryogenic pump and a partially assembled/disassembled cryogenic pump.

FIG. 3 illustrates an apparatus generally designated 100 for horizontally assembling the exemplary cryogenic pump 10 described in FIG. 2. Although reference is made to the cryogenic pump 30 of FIG. 2, it is to be understood that the apparatus 100, process, and kit described herein can be employed for any length, any type, and any weight of cryogenic pump assembled or disassembled. Moreover, the apparatus, process, and kit can be adapted for use with any number of modules or components employed to complete the assembly or disassembly of a cryogenic pump. The use of the terms assembly and disassembly is intended to include the placement of an assembled cryogenic pump as well.

The apparatus 100 generally includes a workstand 102, a plurality of support stands 120 longitudinally spaced apart from the workstand for supporting each module or part of the cryogenic pump as it is assembled/disassembled, and a roller transport structure 140 for supporting the pump parts and shafts as well as maintaining alignment of the pump shaft 56 during assembly or disassembly. Preferably, the apparatus 100 further includes one or more alignment guide rails 190 to provide an alignment guide for the support stands 120 and roller transport structure 140 during assembly or disassembly of the cryogenic pump 10. The alignment guide rails further provide a surface on which the support stands 120 and roller transport structure 140 can be moved and properly positioned with respect to the various components of the cryogenic pump 30 as it is assembled/disassembled.

Figure 4:
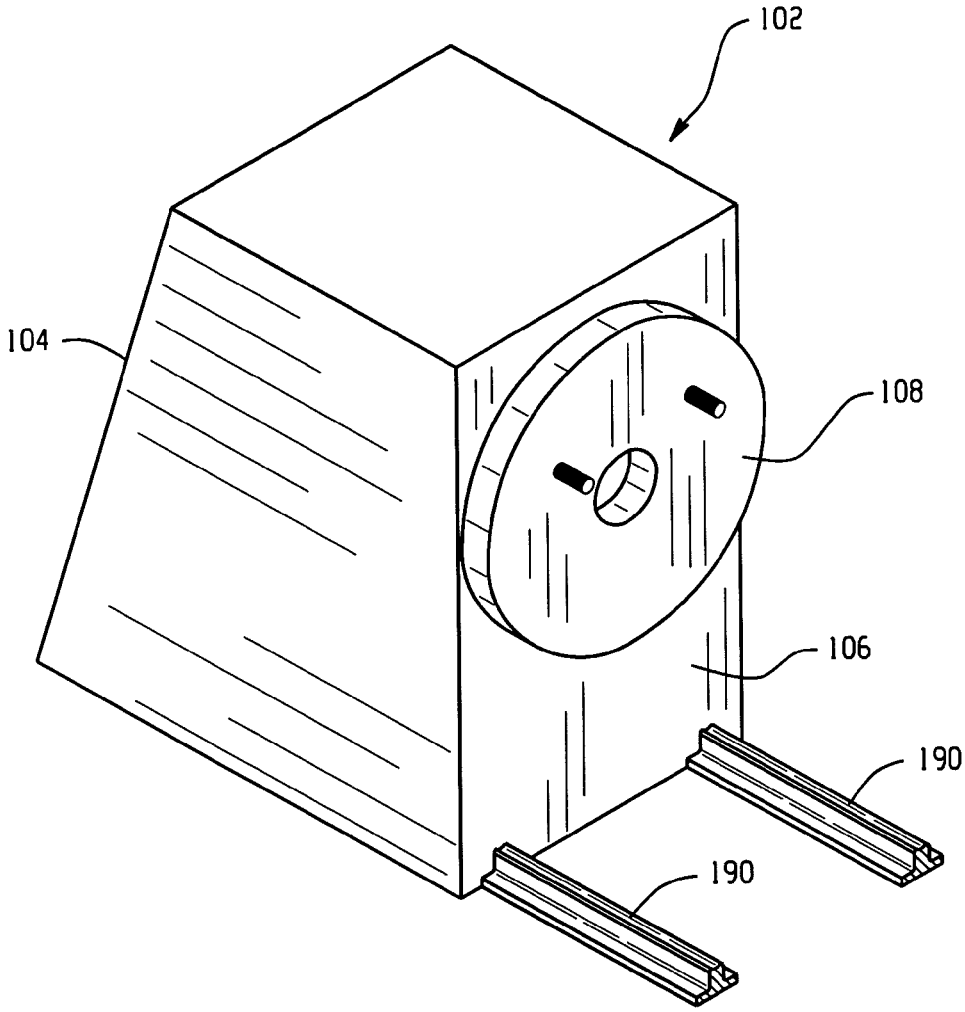
FIG. 4 illustrates a perspective view of a workstand for horizontally assembling a cryogenic pump.
Figure 9:
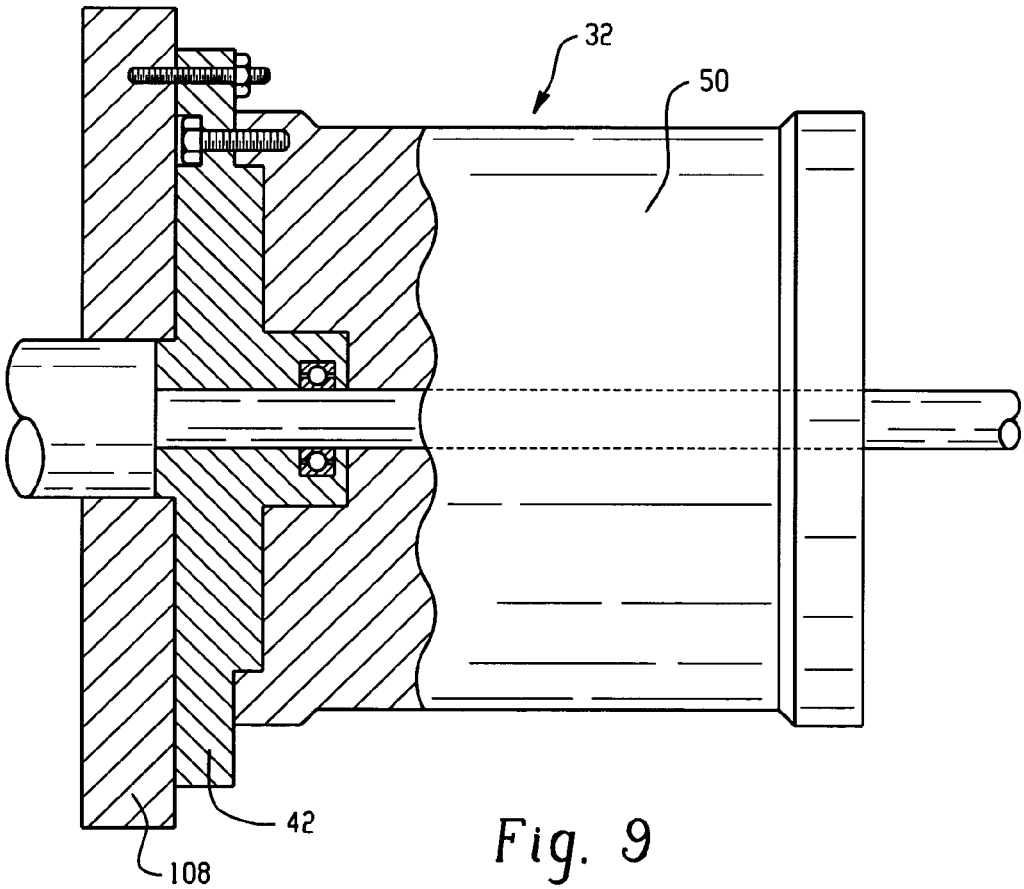
FIG. 9 is a cross sectional view of a mounting plate, an adapter plate and cryogenic pump module.

As shown more clearly in FIG. 4, the workstand 102 generally comprises a base unit 104. The base unit 104 includes a frame for forming sidewalls, wherein one sidewall 106 is perpendicularly oriented with respect to the ground. The base unit 104 is preferably dimensioned to provide stability to the cryogenic pump 30 as it is assembled. The guide rail 190, if present, is preferably fixedly attached to and extending laterally from sidewall 106. The sidewall 106 is further adapted to receive a workstand mounting plate 108, which, during assembly or disassembly, is coupled to an adapter plate 22 (as shown more clearly in FIG. 9) attached to the top of the motor assembly. The workstand mounting plate 108 may be bolted, welded, or otherwise secured to the base unit 104. The mounting plate 108 preferably includes threaded studs projecting from the surface of the workstand for attachment of the adapter plate during assembly/disassembly. Optionally, the workstand mounting plate 108 is adapted to rotate. Rotation may be desirable, for example, for circumferentially staggering the various impellers 58 about the pump shaft 56 of the cryogenic pump 30 during assembly. FIG. 9 illustrates a cross section of an exemplary mounting plate 108 bolted to an adapter plate 42 that had been previously attached to the top end of the motor housing (first module). The adapter plate 42 can be bolted or otherwise secured to the mounting plate 108. Preferably, the mounting plate 108 includes a centrally located recessed portion or opening 109. The central recessed portion or opening 109 is preferably dimensioned for receiving an end of the motor shaft 48.

Alternatively, the sidewall 106 can be adapted such that the adapter plate 42 can be bolted directly thereto. In this embodiment, a mounting plate 108 would not be employed and the pump components would not be rotatable during assembly and disassembly.

Figure 5:
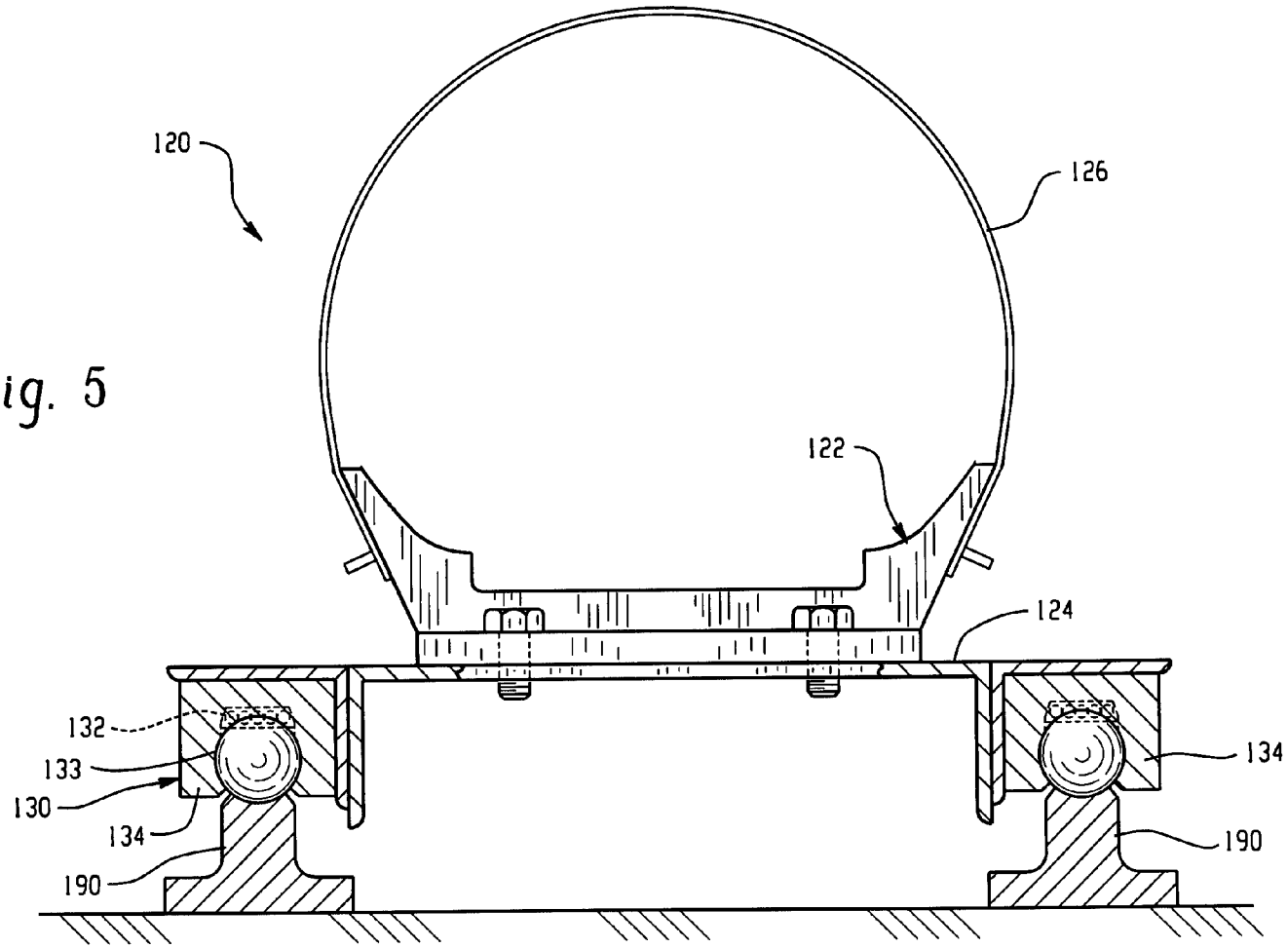
FIG. 5 illustrates a cross-sectional view of a support stand for the apparatus.

FIG. 5 illustrates support stand 120, which provides independent vertical and lateral movement for maintaining alignment and support of the various parts or modules as the pump 10 is assembled or disassembled. The apparatus and kit preferably includes at least one support stand 120. Each support stand 120 carries a cradle 122 on its frame 124, which is adapted to receive and support the various diameters of the diffuser assembly, pump extensions, and the like. The cradle 122 includes a pair of side members that form a C shaped channel cross section. The arc radius of the cradle 122 can preferably be varied to accommodate the various diameters of the cryogenic pump extensions and parts. Alternatively, the cradle 122 can be readily removed and attached such as with bolts or other attachment means so as to accommodate a variety of different cradles having different arc sizes. The cradle 122 may further include an adjustable belt 126 for rigidly securing a pump part to the support stand 120 during the assembly/disassembly process. One end of belt 126 is fixedly attached to a selected one of the side members. Any means of attachment may be used. The other end of the belt 126 is preferably attached to the other side member by means of a releasable lock. The belt 126 has a length effective to accommodate the diameter or perimeter of the pump part. As such, different length pump parts can be moved into or out of position in a stable manner. In an alternative embodiment, the cradle 122 may comprise a rotatable roller 136 disposed on the frame 124 (similar to the rotatable roller 162 shown in FIG. 8).

Optionally, cradle 122 can be mounted on a piston rod of a vertically hydraulic cylinder (similar to that shown in FIG. 7) that is fixedly attached to the frame 124. The cylinder, and any other hydraulic cylinders discussed herein, may then be connected to a pressure supply source that may be actuated independently of other hydraulic motors in the apparatus. In this manner, the cradle 122 can be raised or lowered as desired.

Frame 124 preferably includes casters 130 mounted on a lower surface of the frame 124 for moving the support stand 120 along guide rails 190 into a desired position during the assembly or disassembly processes. An exemplary caster may include a roller bearing 132 and ball 133 assembly as shown and complementary guides 134 extending from or attached to the frame 124 as shown. The casters 130 preferably include a locking or stopping mechanism for preventing further movement of the support stand 120 on the guide rails 190 (or floor) once the support stand 120 is in its desired position. Accordingly, once the support stand is laterally moved to the desired position on the guide rail 190, the cradle 122 may then be adjusted vertically to provide support for the corresponding cryogenic pump module. The illustrated caster 130 is not intended to be limiting and can vary as is known to those skilled in the art, e.g., roller ball bearing assembly, wheels, and the like.

Figure 6:
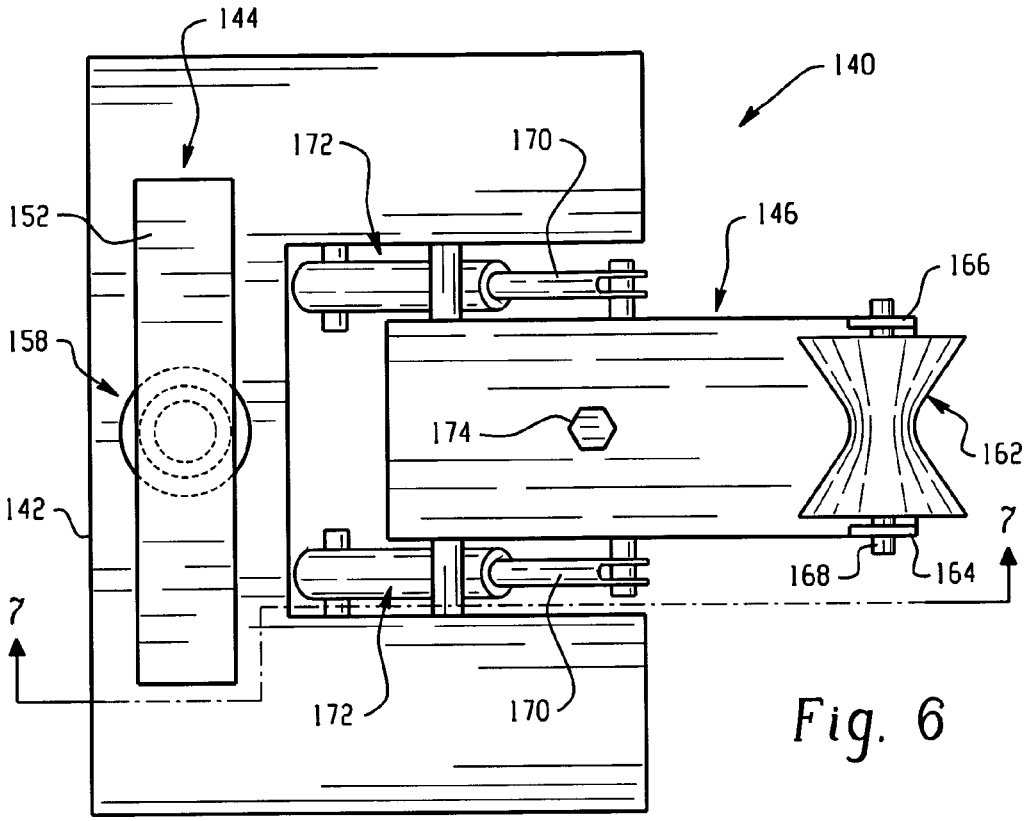
FIG. 6 illustrates a top plan view of a roller transport structure for the apparatus.
Figure 7:
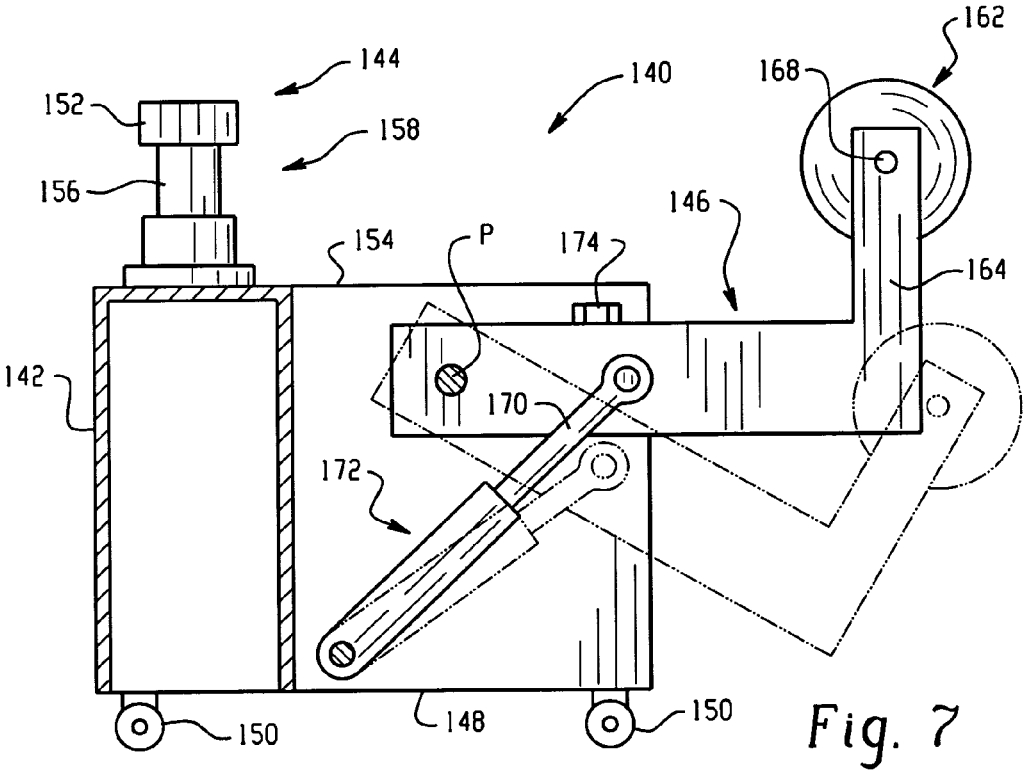
FIG. 7 illustrates a side view of the roller transport structure of FIG. 6.
Figure 8:
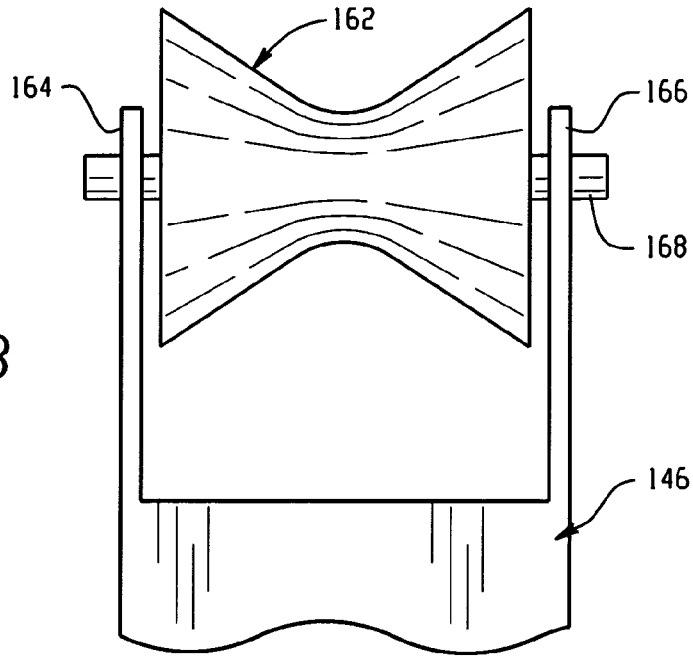
FIG. 8 illustrates an enlarged view of a rotatable roller of the roller transport structure for the apparatus.

Referring now to FIGS. 6–8, the roller transport structure 140 generally includes a platform 142 and supports 144, 146 mounted to the platform 142. The lower surface 148 of the platform 142 preferably includes casters 150 adapted for moving the roller transport structure 140 along the guide rails (or a floor surface) along the longitudinal axis of the cryogenic pump during assembly and disassembly. The casters are not intended to be limiting and can vary as is known to those skilled in the art. Support 144 is optional and includes a cradle 152 mounted to piston rod 156 of a vertically hydraulic cylinder 158 that is fixedly attached to the upper surface 154 of the platform 142, i.e., stationary. The cradle 152 may comprise a planar surface ass shown or alternative may comprise a C-shape channel cross section as previously described with respect to cradle 122. Preferably, support 144 is bolted directly to the upper surface 154 and can be interchanged with similar supports having cradles with different arc radius sizes so that different diameters of pump parts or modules can be accommodated. The cradle 152 may further include an adjustable belt for rigidly securing the particular part or module to the roller transport table 140.

Support 146 comprises an L-shaped elbow, wherein one end of the elbow includes a rotatable roller 162 and the other end is pivotably attached to the platform 142 at point P. As best seen in FIG. 8, the rotatable roller 162 is disposed between stanchions 164, 166 of the support 146 and is rotatably supported by axle 168 extending between the stanchions. The rotatable roller 162 has a C-shaped channel cross section that is adapted to support the circular cross-sectioned shaft portions for maintaining alignment of the pump shaft as the roller transport structure 140 is moved along the longitudinal axis of the cryogenic pump. Piston rod 170 in operative communication with vertically hydraulic cylinder 172 are preferably mounted to each side of the support 146 and the cylinders are mounted to frame 142 to provide a pivoting action about pivot point P. In this manner, support 146 may be raised and lowered (as shown in dotted line in FIG. 7). A stop 174 may be utilized to lock the support 146 in position. The stop 174 engages the frame 142 to prevent movement of the support 146 once the desired position is obtained.

Figure 10:
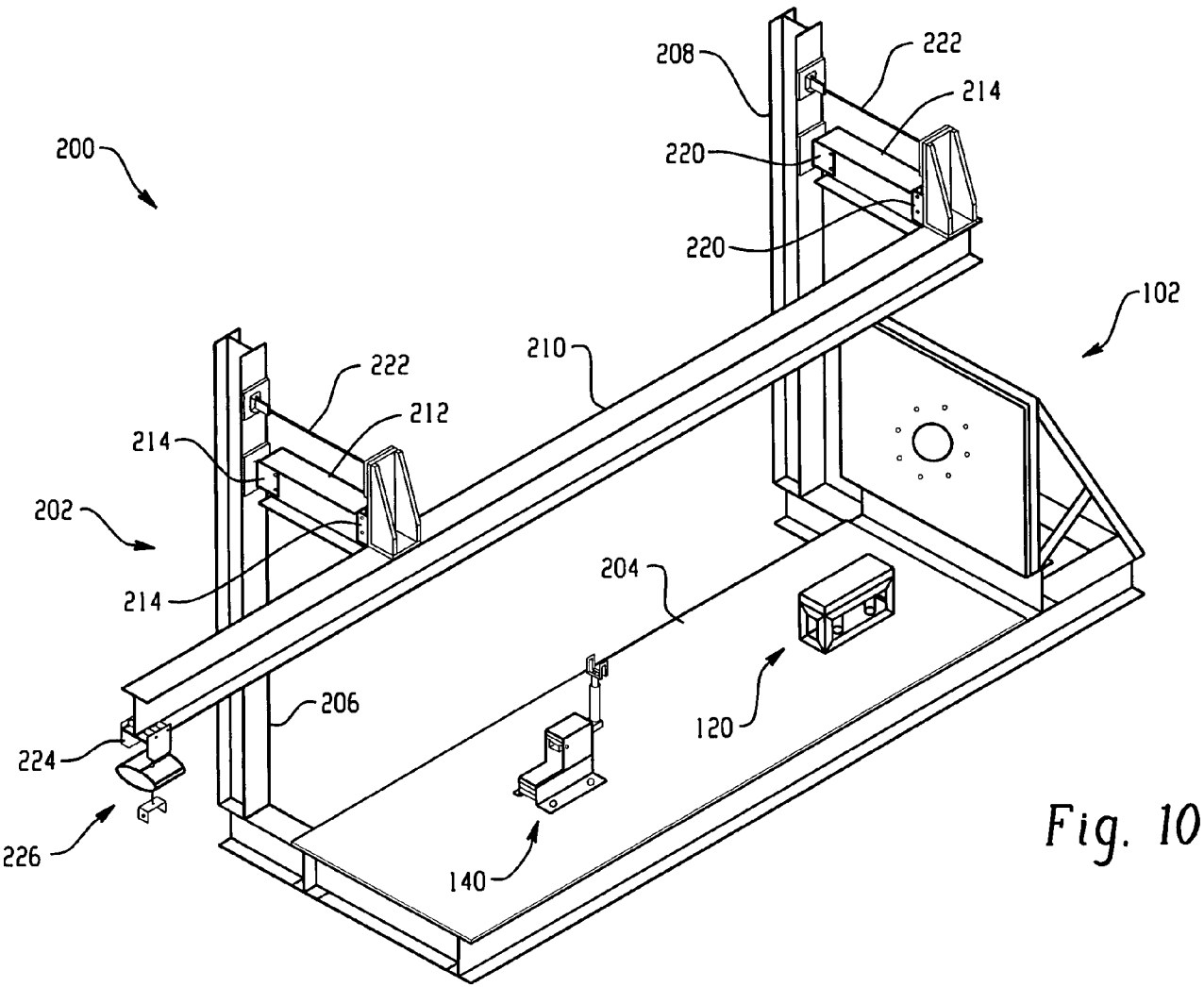
FIG. 10 illustrates a perspective view of an apparatus for horizontally assembling a cryogenic pump and a partially assembled/disassembled cryogenic pump in accordance with another embodiment.

FIG. 10 illustrates an apparatus 200 in accordance with another embodiment. In this embodiment, the apparatus further includes components for forming a beam crane shown generally at 202 upon setup of the apparatus. The components employed for forming the beam crane can include a number of different types of cranes depending on the end-user. The beam crane can be attached directly to the unit or be used as a stand-alone unit. For example, a gantry crane, a jib crane, a bridge type crane, a wall mounted crane, and the like are suitable for use in the kit. In a preferred embodiment, the beam crane is fixedly attached to the base unit 104 so as to minimize space requirements. The preferred beam crane 202 includes two beams 204, 206 extending vertically from the base unit 104. A horizontal beam 208 is fixedly attached to beams 204, 206. Extending laterally from each end of the horizontal beam are jib beams 210, 212. The jib beams 210, 212 are preferably pivotably attached to the horizontal beam. Preferably, the jib beams 210, 212 are I-beams having a flange suitable for attachment of trolley assembly 218, 220, respectively, so as to carry loads along the length of the respective beam. Hoists 222, 224 extend from the respective trolley assembly and can be manipulated vertically with a controller 226, 228 for moving the various pump components as is well known. In this manner, the beam crane permits lateral movement as well as vertical movement. It is also proposed that a construction kit may be provided which is capable of shipment in knock-down form and which may be assembled at the place of use, i.e., without the need for attachment to the workstand.

During an assembly process, the adapter plate 42 is first attached to the motor housing 50 of module 32 as shown in FIG. 9. As previously described, module 32 contains the motor assembly. The module 32 is preferably first oriented in the vertical direction such the adapter plate 42 can be bolted or otherwise secured to the motor housing 50. The module 32 is then lifted with a selected one of the hoists 222 or 224 of the beam crane (or forklift, overhead crane or the like) and bolted in a horizontal position to the mounting plate 108 of the workstand 102. Support stand 120 is then rolled along the guide rails 190 (or floor) and is positioned to support module 32 at an end distally located from the workstand 102. Once laterally positioned, the height of the support stand 120 is then adjusted such that the diameter of the motor housing 50 is supported in the cradle 122. Belt 126 carried by the cradle 122 is disposed about the perimeter of module 32 and tightened to provide stability and prevent further movement.

The pump shaft 30 is then coupled to the motor shaft 48 (i.e., drive shaft) in the first module 32 and supported by additional support stands 120. In a preferred embodiment, support stands 120 contacting the pump shaft 30 include a cradle having a rotatable roller 162, the heights of which are adjusted to support the shaft and maintain alignment during assembly and disassembly. A castle nut or the like is utilized to couple the pump shaft 56 to the motor shaft 48 and is adjusted until the pump shaft 56 has the desired tension. An upper seal ring is then installed over the shaft 30 and abuttedly positioned against the first adapter plate 22. The pump 30 as described above employs a concentrically mounted drive shaft, which, during assembly and disassembly, requires a precisely located support. The use of the apparatus advantageously maintains the precise alignment for assembly and disassembly.

The impellers 58 are then mounted onto the pump shaft 56. A diffuser assembly is lifted onto the roller transport structure 140 and secured to support 144. Preferably, the support 144 includes a belt 126 adjustably affixed to the cradle 122 to stably secure the diffuser assembly to support 144. The diffuser assembly is then moved into position at a rabbet of the adapter plate 42 using the roller transport structure 140, thereby squeezing the upper seal ring to provide a good seal between the shaft 56 and the adapter plate 42. The impeller 58 is then positioned in the vane insert 66 and a collet is employed to secure the impeller 58 on the pump shaft 56. After the last impeller and collet to be contained within module 34 has been set in place, wedges are installed between an upper surface of the impeller 58 and inside of the vane insert 66 to hold the diffuser housing in position. Pump extension 60 is then lifted by crane, forklift, or the like onto the roller support structure 140 and attached to the motor housing 50 by means of the adapter plate 42 affixed thereon. A seal ring is then installed onto the shaft 56 and into position in the pump extension 60 to complete assembly of the second module 34.

The third and fourth modules, 36, and 38, respectively, are then installed in a similar manner. It is to be understood that after the installation of each impeller, the shaft 56 is rotated by 90 degrees to vary the positioning of the shaft bearing clearance about the pump shaft 56. Since the assembly process is horizontally oriented, rotation of the shaft 56 prevents the impeller parts settling in one common direction dictated by gravity, which would result an in an off-balanced pump.

Once the modules 32, 34, 36, and 38 are interconnected, the thus assembled pump is removed from the mounting plate 108 of the workstand 102 so that the discharge manifold 52 installation can be made as well as final connections to make the pump operational. The section pot 40 and pot cover 41 can then be installed.

During disassembly, the assembly process is simply reversed, i.e., the section pot 40 and cover 41 are removed, the discharge manifold is removed and the pump 30 is moved to the apparatus 100, wherein it is attached to the mounting plate 108 of the workstand 102 and further supported by longitudinally spaced apart support stands 120 and roller transport structure 140. Beam crane 202 or the like can be utilized to move the pump 30 for attachment to the workstand.

Advantageously, the apparatus and process overcome some of the problems noted with vertically assembling the cryogenic pump. Elimination of special pit areas and staging is provided with the horizontal process and apparatus as described. Accessibility by the assemblers is significantly improved as well as providing timesavings for assembling or disassembling the pump. Moreover, the apparatus provides a precise alignment mechanism for installing the pump shaft.

While preferred embodiments have been shown and described, various modifications and substitutions may be made thereto without departing from the spirit and scope of the disclosure. Accordingly, it is to be understood that the present disclosure has been described by way of illustration only, and such illustrations and embodiments as have been disclosed herein are not to be construed as limiting to the claims.

What is claimed is:

1. An apparatus for horizontally assembling or disassembling a cryogenic pump, the apparatus comprising:

a workstand comprising a base unit including a vertically oriented sidewall and/or frame comprising a recessed portion for accommodating a motor shaft end of the cryogenic pump and means for attaching an end of a cryogenic pump to the workstand;

a rolling support structure comprising a platform and a pivotable arm having one end of the arm pivotably attached to the platform and an unattached other end of the arm comprising o rotatable support; and at least one support stand intermediate the work stand and the rolling support structure.

2. The apparatus according to claim 1, further comprising a guide rail transversely extending from the sidewall and/or frame of the workstand, wherein the at least one support stand and the roller support structure comprise casters movably ungaged with the guide rail.

3. The apparatus according to claim 1, further comprising a platform extending about a length of the cryogenic pump to be assembled or disassembled, wherein the base unit is attached to an upper surface of the platform, and wherein the at least one support stand and roller transport structure are positioned on the upper surface of the platform to support the cryogenic pump as it is assembled or disassembled.

4. The apparatus according to claim 1, wherein the at least one support stand further comprises a cradle attached to the at least one support stand, wherein the cradle is adapted to receive and support circular cross sections of the cryogenic pump.

5. The apparatus according to claim 4, wherein the cradle of the at least one support stand includes a pair of side members that form a C shaped channel cross section.

6. The apparatus according to claim 4, wherein the support stand further comprises an adjustable belt releasably attached to the cradle.

7. The apparatus according to claim 1, wherein the at least one support stand comprises means for vertically positioning the cradle.

8. The apparatus according to claim 1, wherein the roller support structure further comprises a stationary support surface attached to an upper surface of the platform and adapted to receive and support circular cross sections of the cryogenic pump.

9. The apparatus according to claim 8, wherein the stationary support surface is attached to a piston rod of a vertically oriented hydraulic cylinder.

10. The apparatus according to claim 8, wherein the stationary support surface comprises a cradle adapted to receive and support circular cross sections of the cryogenic pump.

11. The apparatus according to claim 10, wherein the cradle of the stationary support surface further comprises an adjustable belt releasably attached to the cradle.

12. The apparatus according to claim 1, wherein the pivotable arm comprises an L-shaped elbow.

13. The apparatus according to claim 1, further comprising a mounting plate attached to the vertically oriented sidewall, wherein the mounting plate includes a recessed opening dimensioned to accommodate a motor shaft of the cryogenic pump.

14. The apparatus according to claim 13, wherein the mounting plate is rotatably attached to the vertically oriented sidewall.

15. The apparatus according to claim 1, wherein the pivotable arm of the roller support structure is connected to a hydraulic cylinder and piston assembly, wherein the cylinder is fixedly attached to the platform and the piston is attached to the pivotable and slidably connected to the cylinder.

16. The apparatus according to claim 1, wherein the rotatable support of the pivotable arm comprises a grooved roller carried by an axle disposed between stanchions formed at the unattached end of the pivotable arm.

17. The apparatus according to claim 1, wherein the stationary support cradle includes a pair of side members that form a C shaped channel cross section.

18. The apparatus according to claim 1, further comprising a first beam vertically extending from the workstand; a second beam vertically extending from ground spaced apart from the first beam; a horizontal beam pivotably attached to the first and second beams, wherein the horizontal beam can be moved Into a position parallel and coaxial to a longitudinal axis of the cryogenic pump; a trolley assembly attached to the horizontal beam and adapted to laterally move about a length of the horizontal beam; and a hoist extending from the trolley assembly and adapted for vertical movement.

19. The apparatus according to claim 1, wherein the horizontal beam pivotably attached to the first and second beams comprises a plurality of hinged members connecting the horizontal beam to the first and second beams, and a tie rod pivotably connected to each one of the first and second beams and pivotably connected to a point of attachment to the horizontal beam.

20. A kit for assembling a cryogenic pump comprising:

the apparatus of claim 1; and a beam crane comprising a first beam vertically extending from the workstand;

a second beam vertically extending from ground spaced apart from the first-beam; a horizontal beam pivotably attached to the first and second beams, wherein the horizontal beam can be moved into a position parallel and coaxial to a longitudinal axis of the cryogenic pump; a trolley assembly attached to the horizontal beam and adapted to laterally move about a length of the horizontal beam; and a hoist extending from the trolley assembly and adapted for vertical movement.

21. The kit according to claim 20, wherein the horizontal beam pivotably attached to the first and second beams comprises a plurality of hinged members connecting the horizontal beam to the first and second beams, and a tie rod pivotably connected to each one of the first and second beams and pivotably connected to a point of attachment to the horizontal beam.

22. A process for horizontally assembling a cryogenic pump, comprising:

horizontally aligning and inserting an end of a motor shaft into a recess of a workstand, wherein the recess is formed in a vertically oriented sidewall and/or frame of the workstand;

maintaining alignment of the motor shaft and supporting the motor shaft in a cradle of at least one support stand longitudinally spaced from the base unit;

attaching a pump shaft to the motor shaft;

supporting and maintaining alignment of the pump shaft with a roller transport structure and/or the at least one support stand, wherein the roller transport structure comprises a platform and a pivotable arm having one end of the arm pivotably attached to the platform and an unattached other end of the arm comprising a rotatable support; and adding additional modules or components to form the cryogenic pump, wherein each additional module or component is oriented horizontally during, assembly of the cryogenic pump.

23. The process according to claim 22, wherein horizontally aligning and inserting the end of the motor shaft into the recess of the workstand comprises hoisting the motor shaft with a hoist of a beam crane, wherein the beam crane comprises a first beam vertically extending from the workstand; a second beam vertically extending from ground spaced apart from the first beam, a horizontal beam pivotably attached to the first and second beams, wherein the horizontal beam can be moved into a position parallel and coaxial to a longitudinal axis cryogenic pump, n trolley assembly attached to the horizontal beam and adapted to laterally move about a length of the horizontal beam, and a hoist extending from the trolley assembly and adapted for vertical movement.

24. The process according to claim 22, further comprising detaching the assembled cryogenic from the base unit, wherein each detached module or component is oriented horizontally during disassembly of the pump.

25. The process according to claim 22, wherein the steps of inserting the end of the motor shaft attaching a pump shaft to the motor shaft, and adding of the additional modules or components to form the cryogenic pump comprises hoisting the motor shaft, pump shaft, and the additional modules or components into position with a beam crane attached to the workstand.

26. The process according to claim 22, comprising disassembling the cryogenic pump by stepwise removing each module and component from the cryogenic pump in a direction horizontal to ground.

27. The process according to claim 22, wherein horizontally aligning and inserting the end of the motor shaft into the recess of the workstand comprises attaching a mounting plate to the workstand and attaching an adapter plate to the first module of the cryogenic pump, wherein the mounting plate comprises a recessed opening dimensioned for accommodating the end of the motor shaft.

28. The process according to claim 27, further comprising rotating the mounting plate during the assembly and disassembly of the cryogenic pump.

* * * * *